US006887637B2

(12) United States Patent
Niwa

(10) Patent No.: US 6,887,637 B2
(45) Date of Patent: May 3, 2005

(54) TONER FOR ELECTROSTATIC IMAGE DEVELOPMENT AND PROCESS FOR PRODUCING THE SAME

(75) Inventor: Kazu Niwa, Kawasaki (JP)

(73) Assignee: Zeon Corporation, Tokyo (JP)

( * ) Notice: Subject to any disclaimer, the term of this patent is extended or adjusted under 35 U.S.C. 154(b) by 0 days.

(21) Appl. No.: 10/182,708

(22) PCT Filed: Feb. 13, 2001

(86) PCT No.: PCT/JP01/00974

§ 371 (c)(1),
(2), (4) Date: Aug. 8, 2002

(87) PCT Pub. No.: WO01/59526

PCT Pub. Date: Aug. 16, 2001

(65) Prior Publication Data

US 2003/0027070 A1 Feb. 6, 2003

(30) Foreign Application Priority Data

Feb. 10, 2000 (JP) ..... 2000-033450

(51) Int. Cl.[7] ..... G03G 9/087

(52) U.S. Cl. ..... 430/108.22; 430/110.2; 430/137.11; 430/137.17

(58) Field of Search ..... 430/108.22, 110.2, 430/137.11, 137.17

(56) References Cited

U.S. PATENT DOCUMENTS

| | | | |
|---|---|---|---|
| 4,840,863 | A | 6/1989 | Otsu et al. |
| 6,136,490 | A | 10/2000 | Ogawa et al. |
| 6,365,313 | B1 | 4/2002 | Masuo et al. |

FOREIGN PATENT DOCUMENTS

| | | |
|---|---|---|
| EP | 0690354 A2 | 1/1996 |
| EP | 0 836 122 A1 | 4/1998 |
| JP | 59-062871 | 4/1984 |
| JP | 59-123852 | 7/1984 |
| JP | 63-060458 | 3/1988 |
| JP | 03-175456 | 7/1991 |
| JP | 09-204073 | 8/1997 |
| JP | 11-015192 | 1/1999 |
| JP | 11-288129 | 10/1999 |
| WO | WO99/47982 | 9/1999 |

OTHER PUBLICATIONS

European Search Report dated Oct. 28, 2004.

*Primary Examiner*—John L Goodrow
(74) *Attorney, Agent, or Firm*—Armstrong, Kratz, Quintos, Hanson & Brooks, LLP

(57) ABSTRACT

A toner for electrostatic image development, which comprises a binder resin, a colorant and a charge control resin, wherein the charge control resin is a copolymer composed a vinyl monomer unit and a quaternary ammonium salt group-containing (meth)acrylate monomer unit and has a glass transition temperature of 40 to 75° C., and a production process thereof.

11 Claims, No Drawings

TONER FOR ELECTROSTATIC IMAGE DEVELOPMENT AND PROCESS FOR PRODUCING THE SAME

TECHNICAL FIELD

The present invention relates a toner for electrostatic image development for developing electrostatic images formed by an electrophotographic process, electrostatic recording process or the like and a production process thereof.

BACKGROUND ART

In an image forming apparatus such as an electrophotographic apparatus or electrostatic recording apparatus, an electrostatic image formed is first developed with a toner for electrostatic image development (hereinafter may be referred to as a toner merely). After the toner image formed is then transferred to a transfer medium such as paper or OHP film, the unfixed image is fixed thereto by any of various methods such as heating, pressing and use of solvent vapor.

A toner for electrostatic image development is generally composed of colored polymer particles (colored resin particles) comprising a binder resin and a colorant. Processes for producing the toner for electrostatic image development are roughly divided into a pulverizing process and a polymerization process. In the pulverizing process, a colorant, a charge control agent, a parting agent and the like are melted and mixed in a thermoplastic resin to uniformly disperse them therein, thereby preparing a composition, and the composition is then pulverized and classified, thereby producing a toner. In the polymerization process, a monomer composition obtained by uniformly dissolving or dispersing a polymerizable monomer, a colorant, a charge control agent, a parting agent and the like in one another is poured into water or an aqueous dispersion medium composed mainly of water, which contains a dispersion stabilizer, and the mixture is stirred until the droplet diameter of droplets becomes fixed. A polymerization initiator is added to the mixture, and the monomer composition is dispersed by means of a mixer having high shearing force to form the monomer composition into fine droplets. The droplets are then subjected to polymerization, filtration, washing, dehydration and drying, thereby producing a toner. According to the polymerization process, a toner having a desired particle diameter and a sharp particle diameter distribution can be obtained without conducting pulverization and classification.

In copying machines, printers and the like of an electrophotographic system, it has recently been attempted to reduce demand power. A step in which energy is particularly demanded in the electrophotographic system is the so-called fixing step conducted after transferring a toner from a photosensitive member to a transfer medium. A heating roll heated to at least 150° C. is generally used for fixing, and electric power is used as an energy source therefor. It is effective from the viewpoint of energy saving to lower the temperature of the heating roll.

Besides, the speeding-up of copying and printing has been strongly required with the advancement of the combination of image forming apparatus and the formation of personal computer network. In such high-speed copying machines and high-speed printers, it is necessary to conduct fixing in a shorter time.

In order to meet such requirements from the image forming apparatus in the design of a toner, it is only necessary to lower a glass transition temperature of a binder resin. When the glass transition temperature of the binder resin is lowered, however, the resulting toner becomes poor in the so-called shelf stability because particles themselves of the toner undergo blocking during storage or in a toner box to aggregate.

On the other hand, in the case of color toners used in the electrophotographic system, development is generally conducted with color toners of 3 or 4 different colors to transfer the resulting toner image to a transfer medium at a time or by 3 or 4 installments, and the toner image is then fixed. Therefore, the thickness of the toner layer to be fixed becomes thicker compared with a black-and-white image. In addition, the respective color toners overlapped are required to be uniformly melted, and so the melt viscosity of each toner at about the fixing temperature thereof must be designed low compared with the conventional toners. Means for lowering the melt viscosity of the toner include, for example, methods in which the molecular weight of a resin used is made lower compared with the resins for the conventional toners, and in which the glass transition temperature thereof is lowered. In any of these methods, however, the toner becomes poor in shelf stability because the toner tends to undergo blocking.

As described above, there is an adverse correlation between the shelf stability of a toner and the means for coping with the lowering of the fixing temperature of the toner, the speeding-up of printing and the formation of color images.

On the other hand, Japanese Patent Application Laid-Open No. 59-62871 has proposed a positively charged polymerized toner making use of a nigrosine dye as a charge control agent. However, the nigrosine dye is not suitable for use in color toners because its color is black though it exhibits excellent charge control property in a small amount.

In order to solve this problem, Japanese Patent Application Laid-Open No. 59-123852 has proposed a process of subjecting a polymerizable monomer and a cationic polymer to suspension polymerization in an anionic dispersing agent, Japanese Patent Application Laid-Open No. 63-60458 a toner obtained by a pulverizing process making use of a charge control resin composed of a quaternary ammonium salt-containing copolymer, and Japanese Patent Application Laid-Open No. 03-175456 and WO 99/47982 a production process of a toner according to a polymerization process in which a colorant and a polymerizable monomer are polymerized in the presence of a quaternary ammonium salt-containing copolymer.

The charge control resins (cationic polymers) specifically described in these publications are high in styrene content. Investigations by the present inventors have revealed that a toner obtained by using a resin having a styrene content of at least 80% by weight as a charge control resin causes fixing failure and deterioration of printing in high-speed continuous printing.

DISCLOSURE OF THE INVENTION

It is an object of the present invention to provide a toner for electrostatic image development, which is excellent in charge stability, good in durability, low in environmental dependence and capable of successfully dispersing a colorant therein, and a production process thereof.

Another object of the present invention is to provide a toner for electrostatic image development, which has a low fixing temperature, is well balanced between shelf stability and fixing ability, can meet the speeding-up of printing, and is suitable for use as a color toner, and a production process thereof.

The present inventors have carried out an extensive investigation with a view toward overcoming the above-described problems involved in the prior art. As a result, it has been found that the above-described objects can be achieved by using, as a charge control resin, a copolymer composed of a vinyl monomer unit and a quaternary ammonium salt group-containing (meth)acrylate monomer unit and having a glass transition temperature (hereinafter may be referred to as "Tg") of 40 to 75° C.

According to the present invention, there is thus provided a toner for electrostatic image development, comprising at least a binder resin, a colorant and a charge control resin, wherein the charge control resin is a copolymer composed a vinyl monomer unit and a quaternary ammonium salt group-containing (meth)acrylate monomer unit and having a glass transition temperature of 40 to 75° C.

According to the present invention, there is also provided a process for producing a toner for electrostatic image development, comprising suspending a monomer composition containing at least a polymerizable monomer, a colorant and a charge control resin in an aqueous dispersion medium containing a dispersion stabilizer and polymerizing the monomer using a polymerization initiator, wherein the charge control resin is a copolymer composed a vinyl monomer unit and a quaternary ammonium salt group-containing (meth)acrylate monomer unit and has a glass transition temperature of 40 to 75° C.

According to the present invention, there is further provided a process for producing a core-shell type toner for electrostatic image development, comprising suspending a monomer composition containing at least a polymerizable monomer, a colorant and a charge control resin in an aqueous dispersion medium containing a dispersion stabilizer, polymerizing the monomer using a polymerization initiator, thereby forming core particles, and then adding and polymerizing a polymerizable monomer for shell, which is capable of forming a polymer having a glass transition temperature higher than that of a polymer formed from the first mentioned polymerizable monomer, in the presence of the core particles, wherein the charge control resin is a copolymer composed a vinyl monomer unit and a quaternary ammonium salt group-containing (meth)acrylate monomer unit and has a glass transition temperature of 40 to 75° C.

BEST MODE FOR CARRYING OUT THE INVENTION

1. Toner for Electrostatic Image Development:

The toner for electrostatic image development according to the present invention comprises a binder resin, a colorant and, as a charge control resin, a copolymer composed a vinyl monomer unit and a quaternary ammonium salt group-containing (meth)acrylate monomer unit. The toner may contain a parting agent and a magnetic material, and other additives as needed.

The volume average particle diameter of the toner for electrostatic image development according to the present invention is generally 2 to 10 μm, preferably 2 to 9 μm, more preferably 3 to 8 μm. A ratio (dv/dp) of the volume average particle diameter (dv) to the number average particle diameter (dp) is generally at most 1.7, preferably at most 1.5, more preferably at most 1.3.

The toner for electrostatic image development according to the present invention is preferably a core-shell type toner that has 2 different polymers, respectively, in the interior (core layer) and the exterior (shell layer) of each toner particle. In the core-shell type toner, a polymer having a low grass transition temperature which forms a core layer is covered with a shell layer of a polymer having a glass transition temperature higher than that of the core polymer, whereby lowering of the fixing temperature and prevention of aggregation upon storing can be well balanced with each other.

External additives can also be added to the toner for electrostatic image development according to the present invention.

(1) Charge Control Agent:

In the present invention, a charge control resin which is a copolymer composed of a vinyl monomer unit and a quaternary ammonium salt group-containing (meth)acrylate monomer unit and having a glass transition temperature of 40 to 75° C. is used for the purpose of controlling the charge property of the resulting toner for electrostatic image development.

The amount of the charge control resin used is generally 0.01 to 15 parts by weight, preferably 0.5 to 10 parts by weight per 100 parts by weight of the binder resin. If the amount of the charge control resin is too small, it is difficult to impart sufficient charge property to the resulting toner. If the amount is too great, problems such as increase of environmental dependence of image quality, occurrence of offset and staining of a photosensitive member are easy to arise.

(2) Vinyl Monomer Unit:

The vinyl monomer unit making up the charge control resin used in the present invention is a repeating unit obtained by polymerizing a vinyl monomer.

Typical examples of the vinyl monomer include vinyl aromatic hydrocarbon monomers and (meth)acrylate monomers.

Specific examples of the vinyl aromatic hydrocarbon monomers include styrene, α-methylstyrene, 2-methylstyrene, 3-methylstyrene, 4-methylstyrene, 2-ethylstyrene, 3-ethylstyrene, 4-ethylstyrene, 2-propylstyrene, 3-propylstyrene, 4-propylstyrene, 2-isopropylstyrene, 3-isopropylstyrene, 4-isopropylstyrene, 2-chlorostyrene, 3-chlorostyrene, 4-chlorostyrene, 2-methyl-α-methylstyrene, 3-methyl-α-methylstyrene, 4-methyl-α-methylstyrene, 2-ethyl-α-methylstyrene, 3-ethyl-α-methylstyrene, 4-ethyl-α-methylstyrene, 2-propyl-α-methylstyrene, 3-propyl-α-methylstyrene, 4-propyl-α-methylstyrene, 2-isopropyl-α-methylstyrene, 3-isopropyl-α-methylstyrene, 4-isopropyl-α-methylstyrene, 2-chloro-α-methylstyrene, 3-chloro-α-methylstyrene, 4-chloro-α-methylstyrene, 2,3-dimethyl-styrene, 3,4-dimethylstyrene, 2,4-dimethylstyrene, 2,6-dimethylstyrene, 2,3-diethylstyrene, 3,4-diethylstyrene, 2,4-diethylstyrene, 2,6-diethylstyrene, 2-methyl-3-ethylstyrene, 2-methyl-4-ethylstyrene, 2-chloro-4-methylstyrene, 2,3-dimethyl-α-methylstyrene, 3,4-dimethyl-α-methylstyrene, 2,4-dimethyl-α-methylstyrene, 2,6-dimethyl-α-methylstyrene, 2,3-diethyl-α-methylstyrene, 3,4-diethyl-α-methylstyrene, 2,4-diethyl-α-methylstyrene, 2,6-diethyl-α-methylstyrene, 2-ethyl-3-methyl-α-methyl-styrene, 2-methyl-4-propyl-α-methylstyrene and 2-chloro-4-ethyl-α-ethyl-α-methylstyrene.

Specific examples of the (meth)acrylate monomers include (meth)acrylate compounds (hereinafter referred to as "(meth)acrylate compounds" merely), such as acrylates such as methyl acrylate, ethyl acrylate, propyl acrylate, isopropyl acrylate, n-butyl acrylate, isobutyl acrylate, n-amyl acrylate, isoamyl acrylate, n-hexyl acrylate, 2-ethylhexyl acrylate, hydroxypropyl acrylate and lauryl acrylate; and methacrylates such as methyl methacrylate, ethyl methacrylate, propyl methacrylate, isopropyl methacrylate, n-butyl methacrylate, isobutyl methacrylate, n-amyl methacrylate, isoamyl methacrylate, n-hexyl methacrylate, 2-ethylhexyl methacrylate, hydroxypropyl methacrylate and lauryl methacrylate.

The charge control resin according to the present invention desirably has both structural unit derived from a vinyl aromatic hydrocarbon compound and structural unit derived from a (meth)acrylate compound. A proportion (by weight) between both structural units is generally 70:30 to 90:10, preferably 75:25 to 88:12. When the proportion falls within this range, a resin having the intended Tg is easy to be obtained. It is hence preferable to have both structural units within such a range.

The quaternary ammoniunm salt group-containing (meth) acrylate monomer unit making up the charge control resin used in the present invention is a repeating unit represented by, for example, the formula (A):

(A)

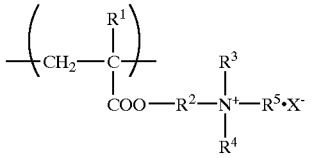

wherein $R^1$ is a hydrogen atom or methyl group, $R^2$ is an alkylene group having 1 to 3 carbon atoms, $R^3$ to $R^5$ are, independently of each other, an alkyl group having 1 to 6 carbon atoms, phenyl group or aralkyl group having 7 to 12 carbon atoms, and X is a halogen atom, alkylsulfonic group having 1 to 6 carbon atoms, benzenesulfonic group or p-toluenesulfonic group.

The content of the quaternary ammonium salt group-containing (meth)acrylate monomer unit in the charge control resin is generally 0.05 to 12% by weight, preferably 0.1 to 10% by weight. When the content falls within this range, such a resin can easily control the charge level of the resulting toner and has little influence by environmental changes on image quality. If the content is too high, the charge level becomes too high, which forms the cause of fogging. It is hence not preferable to contain the quaternary ammonium salt group-containing (meth)acrylate monomer unit in such a too high proportion.

In the present invention, the content of the quaternary ammonium salt group-containing (meth)acrylate monomer unit can be calculated out on the basis of a ratio of the respective monomers charged in a polymerization reaction. When conditions upon polymerization are unknown, the content can be determined by an instrumental analysis such as $^1$H-NMR spectrum or IR spectrum.

The glass transition temperature of the charge control resin is 40 to 75° C., preferably 40 to 70° C. When Tg is lower than 40° C., such a resin is easy to bleed from the binder resin upon melting and cooling, and so the shelf stability and flowability of the resulting toner are deteriorated though the reason for it is not clearly known. If Tg is too high on the other hand, the fixing ability of the resulting toner is deteriorated. A difference between Tg of a binder resin, which will be described subsequently, and Tg of the charge control resin is preferably 0 to 20° C., more preferably 0 to 15° C. because the resulting toner is well balanced between fixing ability, and shelf stability and flowability, and such a toner achieves stable image quality.

In the present invention, Tg is a value measured by a differential scanning calorimeter (DSC).

With respect to the weight average molecular weight (hereinafter may be referred to as "Mw") of the charge control resin in terms of monodisperse polystyrene as measured by gel permeation chromatography (GPC) using tetrahydrofuran, the lower limit is generally at least 2,000, preferably at least 10,000, more preferably at least 17,000, particularly preferably at least 20,000, and the upper limit is generally at most 40,000, preferably at most 35,000, more preferably at most 30,000, particularly preferably at most 28,000. If the weight average molecular weight is too high, handling upon the preparation of toner particles becomes poor, and the size of the droplets becomes varied, so that uniform toner particles cannot be obtained. If the weight average molecular weight is too low on the other hand, the dispersibility of the pigment in the resulting toner is lowered, and difficulty is encountered on the provision of satisfactory charge property, resulting in a print sample fogged.

The use of this charge control resin permits providing a toner for electrostatic image development, which can retain particularly good image quality.

The charge control resin used in the present invention can be prepared in accordance with the following processes: (1) a process of copolymerizing a vinyl aromatic hydrocarbon monomer and a quaternary ammonium salt group-containing (meth)acrylate monomer; (2) a process of reacting the copolymer obtained by the process (1) with p-toluenesulfonic acid, methanesulfonic acid or the like; and (3) a process of quaternizing a copolymer obtained by copolymerizing a vinyl monomer and a dialkylaminoalkyl (meth)acrylate monomer with a quaternizing agent such as methyl p-toluenesulfonate or methyl methanesulfonate.

Examples of the quaternary ammonium salt group-containing (meth)acrylate monomer include N,N,N-trimethyl-N-(2-methacryloxyethyl)ammonium chloride (DMC: dimethylaminoethylmethyl methacrylate chloride) and N-benzyl-N,N-dimethyl-N-(2-methacryloxyethyl) ammonium chloride (DML: dimethylaminoethylbenzyl methacrylate chloride). The quaternary ammonium salt group-containing (meth)acrylate can also be obtained by quaternizing an amino group-containing (meth)acrylate with a quaternizing agent such as a halogenated organic compound or acid esterifying agent.

Examples of the dialkylaminoalkyl (meth)acrylate used in the process (3) include dimethylaminoethyl (meth)acrylate, diethylaminoethyl (meth)acrylate, dipropylmethyl (meth) acrylate and dibutylaminoethyl (meth)acrylate.

Examples of the quaternizing agent include halogenated organic compounds such as methyl chloride, methyl bromide, ethyl chloride, ethyl bromide, benzyl chloride and benzyl bromide; and sulfonic acid alkyl esters such as methylsulfonic acid alkyl esters, ethylsulfonic acid alkyl esters, propylsulfonic acid alkyl esters, benzenesulfonic acid alkyl esters and p-toluenesulfonic acid alkyl esters.

As a polymerization process for obtaining the charge control resin used in the present invention, may be used any process of emulsion polymerization, dispersion polymerization, suspension polymerization, solution polymerization, etc. However, the solution polymerization is particularly preferred in that the intended weight average molecular weight is easy to achieve.

When the polymerization is performed by the solution polymerization, an organic solvent is required. Examples of organic solvents used include general solvents such as hydrocarbon solvents, alcohol solvents, ketone solvents, ester solvents, amide solvents, ether solvents and carbon chloride solvents. These solvents may be used either singly or in any combination thereof.

Polymerization temperature and polymerization time may be optionally selected according to the kinds of polymerization process and polymerization initiator used, and the like. However, the polymerization temperature is generally about 50 to 200° C., and the polymerization time is generally about 0.5 to 20 hours. Upon polymerization, conventionally known various additives, for example, a polymerization aid such as an amine, may also be used in combination. After the solution polymerization, the reaction mixture may be used for obtaining toner particles as it is. Alternatively, the resultant copolymer may be isolated for use by subjecting the reaction mixture to a process of adding a poor solvent to the reaction mixture, a process of removing the solvent by steam, or a process of removing the solvent under reduced pressure.

(2) Binder Resin:

As the binder resin, may be used any of resins widely used in the conventional toners for electrostatic image development. Examples thereof include polymers of styrene and substituted products thereof, such as polystyrene, poly(p-chlorostyrene) and polyvinyl toluene; styrene copolymers such as styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloro-methacrylate copolymers, styrene-acrylonitrile copolymers, styrene-vinyl methyl ether copolymers, styrene-vinyl ethyl ether copolymers, styrene-vinyl methyl ketone copolymers, styrene-butadiene copolymers, styrene-isoprene copolymers, styrene-acrylonitrile-indene terpolymers, styrene-maleic acid copolymers and styrene-maleic acid ester copolymers; and besides polymethyl methacrylate, polyvinyl chloride, polyvinyl acetate, polyethylene, polypropylene, polyester, polyurethane, polyamide, epoxy resins, polyvinyl butyral, polyacrylic acid resins, rosin, modified rosin, terpene resins, phenol resins, aliphatic or alicyclic hydrocarbon resins, aromatic petroleum resins, chlorinated paraffin and paraffin waxes. These resins may be used either singly or in any combination thereof.

(3) Colorant:

As the colorant, may be used any of various kinds of pigments and/or dyes in addition to carbon black and titanium white. When carbon black is used, that having a primary particle diameter of 20 to 40 nm is preferably used. If the primary particle diameter is too small, such carbon black cannot be sufficiently dispersed, and so the resulting toner may often cause fogging. If carbon black having a too great primary particle diameter is used on the other hand, a content of polyvalent aromatic hydrocarbon compounds becomes high, and so the safety of the resulting toner in environment may be lowered in some cases.

When color toners are provided, pigments and dyes such as yellow colorants, magenta colorants and cyan colorants are generally used. The combination of these color toners permits providing a full-color image.

As the yellow colorants, may be used compounds such as azo pigments and fused polycyclic pigments. Specific examples thereof include C.I. Pigment Yellow 3, 12, 13, 14, 15, 17, 62, 65, 73, 83, 90, 93, 97, 120, 138, 155, 180 and 181.

As the magenta colorants, may be used compounds such as azo pigments and fused polycyclic pigments. Specific examples thereof include C.I. Pigment Red 48, 57, 58, 60, 63, 64, 68, 81, 83, 87, 88, 89, 90, 112, 114, 122, 123, 144, 146, 149, 163, 170, 184, 185, 187, 202, 206, 207, 209 and 251; and C.I. Pigment Violet 19.

As the cyan colorants, may be used copper phthalocyanine compounds and derivatives thereof, and anthraquinone compounds. Specific examples thereof include C.I. Pigment Blue 2, 3, 6, 15, 15:1, 15:2, 15:3, 15:4, 16, 17 and 60.

The amount of such a colorant is 1 to 10 parts by weight per 100 parts by weight of the binder resin or the polymerizable monomer.

(4) Parting Agent:

In the present invention, a parting agent may be contained in the toner for electrostatic image development. As specific examples of the parting agent, may be mentioned low molecular weight polyolefin waxes such as low molecular weight polyethylene, low molecular weight polypropylene and low molecular weight polybutylene; terminal-modified polyolefin waxes such as low-molecular weight polypropylene oxidized at its molecular chain terminal, low-molecular weight terminal-modified polypropylene substituted at its molecular chain terminal by an epoxy group and block copolymers of these low-molecular weight polypropylenes with low-molecular weight polyethylene, low-molecular weight polyethylene oxidized at its molecular chain terminal, low-molecular weight terminal-modified polyethylene substituted at its molecular chain terminal by an epoxy group and block copolymers of these low-molecular weight polyethylenes with low-molecular weight polypropylene; natural plant waxes such as candelilla, carnauba, rice, Japan wax and jojoba; petroleum waxes such as paraffin, microcrystalline and petrolatum, and modified waxes thereof; mineral waxes such as montan, ceresin and ozokerite; synthetic waxes such as Fischer-Tropsch wax; and polyfunctional ester compounds, such as pentaerythritol esters such as pentaerythritol tetramyristate and pentaerythritol tetrapalmitate, and dipentaerythritol esters such as dipentaerythritol tetramyristate. These parting agents may be used either singly or in any combination thereof.

Among these, synthetic waxes (particularly, Fischer-Tropsch wax), terminal-modified polyolefin waxes, petroleum waxes and polyfunctional ester compounds are preferred. Among the polyfunctional ester compounds, pentaerythritol esters whose endothermic peak temperatures fall within a range of 30 to 200° C., preferably 50 to 180° C., more preferably 60 to 160° C. upon heating thereof in a DSC curve determined by a differential scanning calorimeter, and dipentaerythritol esters whose endothermic peak temperatures fall within a range of 50 to 80° C. are particularly preferred from the viewpoint of a balance between the fixing ability and the parting property in the resulting toner. First of all, dipentaerythritol esters having a molecular weight of at least 1,000, a solubility of 5 parts by weight in 100 parts by weight of styrene at 25° C. and an acid value of at most 10 mg/KOH have a marked effect of lowering the fixing temperature of the resulting toner. The endothermic peak temperature is a value measured in accordance with ASTM D 3418-82.

The parting agent is used in an amount of 0.1 to 20 parts by weight, preferably 1 to 15 parts by weight per 100 parts by weight of the binder resin or the polymerizable monomer.

(5) Magnetic Material:

The colored fine particles may also contain a magnetic material. Examples of the material used in this case include iron oxides such as magnetite, γ-iron oxide, ferrite and iron-excess ferrite; and metals such as iron, cobalt and nickel, alloys of these metals with aluminum, cobalt, copper, lead, magnesium, tin, zinc, antimony, beryllium, bismuth, cadmium, calcium, manganese, selenium, titanium, tungsten and/or vanadium and mixtures thereof.

(6) Other Additives:

In the present invention, the above-described charge control resin is used as an essential component for a charge control agent. However, a charge control agent commonly used may be used in combination as needed.

Examples of such a charge control agent include positive charge control agents such as Bontron N-O1 (product of Orient Chemical Industries Ltd.), Nigrosine Base EX (product of Orient Chemical Industries Ltd.), Bontron P-51 (product of Orient Chemical Industries Ltd.) and Bontron P-53 (product of Orient Chemical Industries Ltd.).

Such other charge control agents may be used in a proportion of at most 20% by weight based on the charge control resin. A charge control agent having negatively charging ability may also be used in combination, as needed, to control the charging ability.

(7) Core-shell Type Toner:

In the case of the core-shell type toner, the volume average particle diameter of the core particles is generally 2 to 10 μm, preferably 2 to 9 μm, more preferably 3 to 8 μm. The ratio of the volume average particle diameter (dv) to the number average particle diameter (dp) is generally at most 1.7, preferably at most 1.5, more preferably at most 1.3.

A proportion of the core layer to the shell layer is generally 80/20 to 99.9/0.1 in terms of a weight ratio. If the proportion of the shell layer is too low, the effect of improving the shelf stability becomes little. If the proportion is too high on the other hand, the improving effect to lower the fixing temperature of the resulting toner becomes little.

The average thickness of the shell layer is generally 0.001 to 1.0 μm, preferably 0.003 to 0.5 μm, more preferably 0.005 to 0.2 μm. If the thickness of the shell layer is too great, the fixing ability of the toner is deteriorated. If the thickness is too small, the shelf stability of the toner is lowered. Incidentally, in the present invention, the whole core layer of the core-shell type toner is not necessarily covered with the shell layer.

The particle diameters of the core particles and the thickness of the shell layer in the core-shell type toner can be determined by directly measuring the size and shell thickness of each of particles selected at random from electron photomicrographs thereof when they can be observed through an electron microscope. If the core and the shell are difficult to observe through the electron microscope, the thickness of the shell can be calculated out from the particle diameter of the core particles and the amount of the monomer used in forming the shell upon the production of the toner.

(8) External Additives:

The external additives have a function (flowability-improving agent) of improving the flowability of the resulting toner particles and besides play a polyfunctional role: for example, the charging ability of the toner is controlled, and abrasiveness is imparted to the toner to prevent occurrence of toner filming on a photosensitive member or the like.

External additives usable in the present invention include inorganic particles and organic resin particles. Examples of the inorganic particles include particles of silicon dioxide, aluminum oxide, titanium oxide, zinc oxide, tin oxide, barium titanate and strontium titanate. Examples of the organic resin particles include particles of methacrylic ester polymers, acrylic ester polymers, styrene-methacrylic ester copolymers and styrene-acrylic ester copolymers, and core-shell type particles in which a core is composed of a styrene polymer, and a shell is composed of a methacrylic ester copolymer. Of these, the particles of the inorganic oxides, particularly, silicon dioxide particles are preferred. The surfaces of these particles can be subjected to a hydrophobicity-imparting treatment, and silicon dioxide particles subjected to the hydrophobicity-imparting treatment are particularly preferred. No particular limitation is imposed on the amount of the external additives used. However, it is generally about 0.1 to 6 parts by weight per 100 parts by weight of the toner particles.

Two or more of the external additives may be used in combination. When the external additives are used in combination, it is preferable to use two kinds of inorganic oxide particles or organic resin particles different in average particle diameter from each other.

More specifically, it is preferable to use particles (preferably, inorganic oxide particles) having an average particle diameter of generally 5 to 20 nm, preferably 7 to 18 nm and particles (preferably, inorganic oxide particles) having an average particle diameter of 20 nm to 2 μm, preferably 30 nm to 1 μm in combination. Incidentally, the average particle diameter of the external additive particles means an average value of particle diameters of 100 particles selected and measured at random from among particles observed through a transmission electron microscope.

The amounts of the above two kinds of external additive particles are generally 0.1 to 3 parts by weight, preferably 0.2 to 2 parts by weight per 100 parts by weight of the toner for the particles having an average particle diameter of 5 to 20 nm and generally 0.1 to 3 parts by weight, preferably 0.2 to 2 parts by weight for the particles having an average particle diameter of 20 nm to 2 μm. A weight ratio of the particles having an average particle diameter of 5 to 20 nm to the particles having an average particle diameter of 20 nm to 2 μm is within a range of generally 1:5 to 5:1, preferably 3:10 to 10:3.

In order to attach the external additives to the toner particles, in general, the external additives and the toner particles are charged into a mixer such as a Henschel mixer to mix them under stirring.

2. Production Process of Toner for Electrostatic Image Development:

The toner for electrostatic image development according to the present invention may be produced by either the pulverizing process or the polymerization process.

3-1. Pulverized Toner:

The pulverized toner may be obtained in the following manner. A binder resin, a colorant, the above-described charge control resin, a parting agent and the like are mixed by means of a mixer such as a Henschel mixer to obtain a composition. The composition is melt and kneaded by means of a kneader such as a twin roll, twin-screw extruder or Busco kneader. The kneaded composition is cooled, pulverized and classified to obtain a toner having the intended particle diameter.

3-2. Polymerized Toner:

The polymerized toner can be produced by any of a suspension polymerization process, emulsion polymerization process and dispersion polymerization process. However, the suspension polymerization process is preferred in that it is an excellent production process in which neither an organic solvent nor an emulsifier is used, and the form of the resulting toner is spherical.

In the suspension polymerization process, a monomer composition containing at least a polymerizable monomer, a colorant and a charge control agent is suspended in an aqueous dispersion medium containing a dispersion stabilizer, and the polymerizable monomer is then polymerized using a polymerization initiator, whereby the toner can be produced.

More specifically, raw materials for toner, such as a colorant, a charge control agent, a parting agent and other additives are uniformly dispersed in a polymerizable monomer by means of a mixing and dispersing machine such as a bead mill to prepare a monomer composition. The monomer composition is then poured into an aqueous dispersion medium containing a dispersion stabilizer, and the resultant mixture is stirred until droplets of the monomer composition become stable. An oil-soluble polymerization initiator is then added, and the resultant mixture is formed into fine droplets by means of a high-speed shearing stirrer in such a manner that the size thereof becomes smaller to the size of the resulting toner particles, thereby obtaining an aqueous dispersion. The resultant aqueous dispersion is heated to the prescribed polymerization temperature in a reactor equipped with an agitating blade to conduct polymerization.

(1) Polymerizable Monomer:

In the present invention, a monovinyl monomer is generally used as the polymerizable monomer. Specific examples of the monovinyl monomer include styrenic monomers such as styrene, vinyltoluene and α-methylstyrene; acrylic acid and methacrylic acid; derivatives of (meth)acrylic acid, such as methyl acrylate, ethyl acrylate, propyl acrylate, butyl acrylate, 2-ethylhexyl acrylate, cyclohexyl acrylate, isobornyl acrylate, cyclohexyl methacrylate, isobornyl methacrylate, dimethylaminoethyl acrylate, methyl methacrylate, ethyl methacrylate, propyl methacrylate, butyl methacrylate, 2-ethylhexyl methacrylate, dimethylaminoethyl methacrylate, acrylamide and methacrylamide; monoolefin monomers such as ethylene, propylene and butylene; vinyl esters such as vinyl acetate and vinyl propionate; vinyl ethers such as vinyl methyl ether and vinyl ethyl ether; vinyl ketones such as vinyl methyl ketone and methyl isopropenyl ketone; and nitrogen-containing vinyl compounds such as 2-vinylpyridine, 4-vinylpyridine and N-vinylpyrrolidone.

These monovinyl monomers may be used either singly or in any combination thereof. Among these monovinyl monomers, the styrenic monomers and combinations of the styrenic monomers and the derivatives of acrylic acid or methacrylic acid are preferably used.

(2) Crosslinkable Compound:

In the production by the polymerization process, the use of a crosslinkable compound such as a crosslinkable monomer or crosslinkable polymer as a polymerizable monomer is effective for improving the hot offset resistance of the resulting toner.

The crosslinkable monomer is a monomer having two or more polymerizable carbon-carbon unsaturated double bonds. As specific examples of the crosslinkable monomer, may be mentioned aromatic divinyl compounds such as divinylbenzene, divinylnaphthalene and derivatives thereof; di-ethylenically unsaturated carboxylic acid esters such as ethylene glycol dimethacrylate and diethylene glycol dimethacrylate; other divinyl compounds having 2 vinyl groups, such as N,N-divinylaniline and divinyl ether; and compounds having three or more vinyl groups, such as pentaerythritol triallyl ether and trimethylolpropane triacrylate.

The crosslinkable polymer is a polymer having two or more polymerizable carbon-carbon unsaturated double bonds. As specific examples thereof, may be mentioned esters of a polymer having two or more hydroxyl groups in its molecule (hydroxyl group-containing polyethylene, hydroxyl group-containing polypropylene, polyethylene glycol, polypropylene glycol or the like) with an ethylenically unsaturated carboxylic acid (acrylic acid, methacrylic acid or the like).

These crosslinkable monomers and crosslinkable polymers may be used either singly or in any combination thereof. The crosslinkable monomer and/or the crosslinkable polymer is used in a proportion of generally at most 10 parts by weight, preferably 0.1 to 2 parts by weight per 100 parts by weight of the polymerizable monomer.

(3) Macromonomer:

In the present invention, it is preferable to use a macromonomer together with the polymerizable monomer from the viewpoint of improving a balance between the shelf stability and fixing ability of the resulting toner.

The macromonomer is an oligomer or polymer having a vinyl polymerizable functional group at its molecular chain terminal and a number average molecular weight of generally 1,000 to 30,000. If a macromonomer having a too low number average molecular weight is used, the surface portions of the resulting polymer particles become soft, whereby the shelf stability of the toner is deteriorated. If a macromonomer having a too high number average molecular weight is used on the other hand, the melt viscosity of the macromonomer itself becomes high, resulting in a toner deteriorated in fixing ability.

The macromonomer used in the present invention preferably has a glass transition temperature higher than that of a polymer obtained by polymerizing the polymerizable monomer.

Among these macromonomers, hydrophilic macromonomers, in particular, polymers obtained by polymerizing methacrylic esters or acrylic esters either singly or in combination of two or more monomers thereof are preferred in the present invention.

The amount of the macromonomer used is generally 0.01 to 10 parts by weight, preferably 0.03 to 5 parts by weight, more preferably 0.05 to 1 part by weight per 100 parts by weight of the polymerizable monomer. If the amount of the macromonomer is too small, the shelf stability of the resulting toner is deteriorated. If the amount of the macromonomer is too great, the fixing ability of the resulting toner is deteriorated.

Such polymerizable monomer, crosslinkable compound and macromonomer are polymerized to form a binder resin.

(4) Dispersion Stabilizer:

As examples of dispersion stabilizers usable in the present invention, may be mentioned metallic compounds, such as sulfates such as barium sulfate and calcium sulfate; carbonates such as barium carbonate, calcium carbonate and magnesium carbonate; phosphates such as calcium phosphate; and metal oxides such as aluminum oxide and titanium oxide; and besides, metal hydroxides such as aluminum hydroxide, magnesium hydroxide and ferric hydroxide; water-soluble polymers such as polyvinyl alcohol, methyl cellulose and gelatin; and surfactants such as anionic surfactants, nonionic surfactants and amphoteric surfactants. Among these, dispersion stabilizers containing colloid of a metallic compound, particularly, a hardly water-soluble metal hydroxide are preferred because the particle diameter distribution of the resulting polymer particles can be narrowed, and the brightness or sharpness of an image formed from such a toner is enhanced.

The dispersion stabilizers containing colloid of the hardly water-soluble metal hydroxide are not limited by the production process thereof. However, it is preferred to use colloid of a hardly water-soluble metal hydroxide obtained by adjusting the pH of an aqueous solution of a water-soluble polyvalent metallic compound to 7 or higher, in particular, colloid of a hardly water-soluble metal hydroxide formed by reacting a water-soluble polyvalent metallic compound with an alkali metal hydroxide in an aqueous phase.

With respect to the proportion of the water-soluble polyvalent metal salt to the alkali metal hydroxide in the reaction, a chemical equivalent ratio A of the alkali metal hydroxide to the water-soluble polyvalent metal salt is within a range of $0.4 \leqq A \leqq 1.0$.

The colloid of the hardly water-soluble metal hydroxide preferably has number particle diameter distributions, $D_{50}$ (50% cumulative value of number particle diameter distribution) of at most 0.5 μm and $D_{90}$ (90% cumulative value of number particle diameter distribution) of at most 1 μm. If the particle diameter of the colloid is too great, the stability of the polymerization is broken, and the shelf stability of the resulting toner is deteriorated.

The dispersion stabilizer is used in a proportion of generally 0.1 to 20 parts by weight per 100 parts by weight of the polymerizable monomer. If this proportion is too low, it is difficult to achieve sufficient dispersion stability of droplets of the polymerizable monomer composition, so that aggregates of the polymer particles are liable to be formed. If this proportion is too high on the other hand, the viscosity of the aqueous dispersion medium is increased, and the particle diameter distribution of the resulting toner particles is widened, and so the yield is lowered.

(5) Polymerization Initiator:

As examples of the polymerization initiator used in the production by the polymerization process, may be mentioned persulfates such as potassium persulfate and ammonium persulfate; azo compounds such as 4,4'-azobis-(4-cyanovaleric acid), 2,2'-azobis(2-amidinopropane) dihydrochloride, 2,2'-azobis-2-methyl-N-1,1-bis-(hydroxymethyl)-2-hydroxyethylpropionamide, 2,2'-azobis (2,4-dimethylvaleronitrile), 2,2'-azobis-isobutyronitrile and 1,1'-azobis(1-cyclohexane-carbonitrile); and peroxides such as methyl ethyl peroxide, di-t-butyl peroxide, acetyl peroxide, dicumyl peroxide, lauroyl peroxide, benzoyl peroxide, t-butyl peroxy-2-ethylhexanoate, t-butyl perbutylneodecanoate, t-hexyl peroxy-2-ethylhexanoate, t-butyl peroxypivalate, t-hexyl peroxypivalate, di-isopropyl peroxydicarbonate, di-t-butyl peroxyisophthalate, 1,1',3,3'-tetramethylbutyl peroxy-2-ethylhexanoate and t-butyl peroxyisobutyrate. Redox initiators composed of combinations of these polymerization initiators with a reducing agent may also be mentioned.

Among these polymerization initiators, it is preferable to select an oil-soluble polymerization initiator soluble in the polymerizable monomer used. A water-soluble polymerization initiator may also be used in combination with the above-described initiator as needed. The polymerization initiator is used in a proportion of generally 0.1 to 20 parts by weight, preferably 0.3 to 15 parts by weight, more preferably 0.5 to 10 parts by weight per 100 parts by weight of the polymerizable monomer. The polymerization initiator may be added into the polymerizable monomer composition in advance, but may also be added to a suspension after completion of formation of the droplets in some cases.

(6) Molecular Weight Modifier:

In the present invention, a molecular weight modifier may be used. As examples of the molecular weight modifier, may be mentioned mercaptans such as t-dodecylmercaptan, n-dodecylmercaptan and n-octylmercaptan; and halogenated hydrocarbons such as carbon tetrachloride and carbon tetrabromide. These molecular weight modifiers may be added before the initiation of the polymerization or in the course of the polymerization. The molecular weight modifier is used in a proportion of generally 0.01 to 10 parts by weight, preferably 0.1 to 5 parts by weight per 100 parts by weight of the monomer.

3-3. Core-shell Type Toner:

The toner for electrostatic image development according to the present invention is not particularly limited by a production process thereof. However, the toner is preferably produced as a core-shell type toner for electrostatic image development by suspending a monomer composition containing at least a polymerizable monomer, a colorant and a charge control agent in an aqueous dispersion medium containing a dispersion stabilizer, polymerizing the monomer using a polymerization initiator, thereby forming core particles, and then adding a polymerizable monomer for shell, which is capable of forming a polymer having a glass transition temperature higher than that of a polymer formed from the first mentioned polymerizable monomer, and a polymerization initiator to polymerize the monomer for shell in the presence of the core particles.

As examples of a specific process for forming the shell layer, may be mentioned a process in which the monomer for shell is added to the reaction system of the polymerization reaction which has been conducted for obtaining the core particles, thereby continuously conducting polymerization, and a process in which the core particles obtained in a separate reaction system are charged, to which the monomer for shell is added, thereby conducting polymerization stepwise.

The monomer for shell may be added to the reaction system in one lot, or continuously or intermittently by means of a pump such as a plunger pump.

(1) Monomer for Core:

As polymerizable monomers for core, the same polymerizable monomers as described above may be exemplified. Among these, a monomer capable of forming a polymer having a glass transition temperature of generally at most 60° C., preferably about 40 to 60° C. is preferred as the monomer for core. If the glass transition temperature of the polymer component forming the core is too high, the fixing temperature of the resulting toner becomes high. If the glass transition temperature is too low on the other hand, the shelf stability of the toner is deteriorated. In general, 2 or more monomers are often used in combination as the monomers for core.

In the present invention, the glass transition temperature (Tg) of a polymer is a calculated value (referred to as calculated Tg) calculated out according to the kinds and proportions of monomers used in accordance with the following equation:

$$100/Tg = W_1/T_1 + W_2/T_2 + W_3/T_3 + \ldots$$

wherein

Tg: the glass transition temperature of the copolymer (absolute temperature), $W_1$, $W_2$, $W_3$ . . . : % by weight of the monomers forming the copolymer, $T_1$, $T_2$, $T_3$ . . . : glass transition temperature (absolute temperature) of a homopolymer formed from each of the monomers.

Incidentally, the numbers attached to W and T indicate that such numerical values are those as to the same monomer.

(2) Monomer for Shell:

The monomer for shell must be preset in such a manner that the glass transition temperature of a polymer formed from the monomer for shell is higher than the glass transition temperature of a polymer forming the core particles. In order to improve the shelf stability of the polymerized toner, the glass transition temperature of the polymer formed from the monomer for shell is generally 50° C. to 120° C., preferably 60° C. to 110° C., more preferably 80° C. to 105° C.

A difference in glass transition temperature between the polymer formed from the monomer for core and the polymer formed from the monomer for shell is generally at least 10° C., preferably at least 20° C., more preferably at least 30° C.

(2) Polymerization Initiator for Shell:

It is preferable to add, as a polymerization initiator, a water-soluble radical polymerization initiator upon addition of the monomer for shell because a core-shell type toner is easy to be obtained. It is considered that when the water-soluble radical initiator is added upon the addition of the monomer for shell, the water-soluble initiator enters in the vicinity of each surface of the core particles to which the monomer for shell has migrated, so that a polymer (shell) is easy to be formed on the core particle surface.

As examples of the water-soluble radical initiator, may be mentioned persulfates such as potassium persulfate and ammonium persulfate; and azo initiators such as 4,4'-azobis (4-cyanovaleric acid), 2,2'-azobis(2-amidinopropane) dihydrochloride and 2,2'-azobis-2-methyl-N-1,1-bis (hydroxymethyl)-2-hydroxyethylpropionamide. The amount of the water-soluble radical initiator used is generally 0.001 to 1% by weight based on the aqueous medium.

EXAMPLES

The present invention will hereinafter be described more specifically by the following Examples and Comparative Examples. All designations of "part" or "parts" and "%" as will be used in the following examples mean part or parts by weight and % be weight unless expressly noted.

Incidentally, various properties and characteristics were evaluated in accordance with the following respective methods.

1. Physical Properties of Toner:

(1) Spheroidicity:

An electron microphotograph of a toner sample was taken, and a ratio (rl/rs) of a length rl to a breadth rs thereof was calculated out about 100 particles per sample to calculate an average value thereof.

(2) Particle Diameter:

The volume average particle diameter (dv) and particle diameter distribution, i.e., a ratio (dv/dp) of the volume average particle diameter to the number average particle diameter (dp) of a polymer particle sample were measured by means of a Multisizer (manufactured by Beckmann Coulter Co.). The measurement by the Multisizer was conducted under the following conditions:

aperture diameter: 100 $\mu$m;

medium: Isothone II, concentration: 10%; and number of particles measured: 100,000 particles.

(3) Thickness of Shell:

In the examples of the present invention, the thickness of shell in each toner sample was calculated out in the following equation, since the thickness of the shell was thin though it can be measured by the Multisizer or through an electron microscope where the thickness of the shell is thick.

$$x=r(1+s/100)^{1/3}-r \quad (1)$$

wherein r: the radius of core particles before addition of a monomer for shell (a half of the volume average particle diameter of the core particles found from measurement by the Multisizer; $\mu$m);

x: the thickness ($\mu$m) of shell;

s: the number of parts of the monomer for shell added (the number of parts per 100 parts by weight of a monomer for core).

In this measurement, the density ρ (g/cm$^3$) of a resin forming the shell is regarded as 1.0.

2. Properties of Toner:

(1) Dependence of Image Quality on Environment:

A commercially available printer (12 papers per minute printer) of the non-magnetic one-component development system was modified in such a manner that the temperature of a fixing roll can be varied. This modified printer was used to continuously conduct printing from the beginning under (H/H) environment of 35° C. in temperature and 80% in humidity and (L/L) environment of 10° C. in temperature and 20% in humidity and count the number of printed sheets that continuously retained an image density of 1.3 or higher as measured by a reflection densitometer (manufactured by McBeth Co.) and at an unprinted area, fog of 10% or lower as measured by a whiteness meter (manufactured by Nippon Denshoku K.K.), thereby evaluating a toner sample as to the dependence of image quality on environment in accordance with the following standard:

○: the number of the printed sheets that continuously retained the above-described image quality was more than 10,000 sheets;

Δ: the number of the printed sheets that continuously retained the above-described image quality was 5,000 to 10,000 sheets; and X: the number of the printed sheets that continuously retained the above-described image quality was less than 5,000 sheets.

(2) Durability:

Printing was continuously conducted from the beginning by means of th above-described modified printer under room-temperature environment of 23° C. in temperature an 50% in humidity to count the number of printed sheets that continuously retained an image densi of 1.3 or higher as measured by a reflection densitometer (manufactured by McBeth Co.) and at n unprinted area, fog of 10% or lower as measured by a whiteness meter (manufactured by Nippon Denshoku K.K.), thereby evaluating the toner sample as to the durability of image quality in accordance with the following standard:

○: the number of the printed sheets that continuously retained the above-described image quality was more than 20,000 sheets;

Δ: the number of the printed sheets that continuously retained the above-described image quality was 15,000 to 20,000 sheets; and X: the number of the printed sheets that continuously retained the above-described image quality was less than 15,000 sheets.

(3) Shelf stability:

Each Toner sample was placed in a closed container to seal it, and the container was sunk into a constant-temperature water bath controlled to 55° C. The container was taken out of the constant-temperature water bath after 8 hours had elapsed, and the toner contained in the container was transferred to a 42-mesh sieve. At this time, the toner was quietly taken out of the container so as not to destroy the aggregate structure of the toner in the container, and carefully transferred to the sieve. The sieve was vibrated for 30 seconds by means of a powder measuring device ("POWDER TESTER", trade name; manufactured by Hosokawa Micron Corporation) under conditions of vibration intensity of 4.5. The weight of the toner remaining on the sieve was then measured to regard it as the weight of the toner aggregated. A proportion (% by weight) of the weight of the aggregated toner to the weight of the toner first put into the container was calculated out. The measurement was conducted 3 times on one sample to use the average value thereof as an index to the shelf stability.

(4) Flowability:

Three kinds of sieves having sieve openings of 150, 75 and 45 μm, respectively, were laid on top of another in that order from above, and a toner (4 g) to be measured was precisely weighed and put on the uppermost sieve. The three kinds of sieves were then vibrated for 15 seconds by means of a powder measuring device ("POWDER TESTER", trade name; manufactured by Hosokawa Micron Corporation) under conditions of vibration intensity of 4. Thereafter, the weight of the toner captured on each sieve was measured and substituted into its corresponding equation ①, ② or ③ shown below, thereby calculating out a value of flowability. The measurement was conducted 3 times on one sample to find an average value thereof.

Numerical expressions:

① a=[weight (g) of the toner remaining on the sieve of 150 μm]/4 g×100

② b=[weight (g) of the developer remaining on the sieve of 75 μm]/4 g×100×0.6

③ c=[weight (g) of the developer remaining on the sieve of 45 μm]/4 g×100×0.2

Flowability (%)=100−(a+b+c)

(5) Fixing Temperature of Toner:

The above-described modified printer was used to conduct a fixing test. The fixing test was carried out by varying the temperature of the fixing roll in the modified printer to determine the fixing rate of each toner sample at each temperature, thereby finding a relationship between the temperature and the fixing rate.

The fixing rate was calculated from the ratio of image densities before and after a peeling operation using an adhesive tape, which was conducted against a black solid-printed area of a test paper sheet, on which printing had been made by the modified printer. More specifically, assuming that the image density before the peeling of the adhesive tape is $ID_{before}$, and the image density after the peeling of the adhesive tape is $ID_{after}$, the fixing rate can be calculated out from the following equation:

$$\text{Fixing rate } (\%)=(ID_{after}/ID_{before})\times 100$$

The peeling operation of the adhesive tape is a series of operation that a pressure-sensitive adhesive tape (Scotch Mending Tape 810-3-18, product of Sumitomo 3M Limited) is applied to a measuring area of the test paper sheet to cause the tape to adhere to the sheet by pressing the tape under a fixed pressure, and the adhesive tape is then peeled at a fixed rate in a direction along the paper sheet. The image density was measured by means of a reflection image densitometer manufactured by McBeth Co.

In this fixing test, a temperature of the fixing roll at which a fixing rate of the toner amounted to 80% was defined as a fixing temperature of the toner.

Example 1

(1) Synthesis of Charge Control Resin A:

A reaction vessel was charged with 60 parts of methanol, 20 parts of toluene, 68 parts of styrene, 22 parts of butyl acrylate, 8 parts of dimethylaminoethyl-benzyl methacrylate chloride and 0.2 parts of azobisdimethylvaleronitrile to conduct a reaction at 60° C. for 12 hours with stirring. The solvent was then removed by distillation under reduced pressure to obtain Charge Control Resin A composed of a quaternary ammonium salt group-containing copolymer having Mw of 30,000 and Tg of 42° C.

(2) Production of Toner:

A monomer component composed of 83 parts of styrene and 17 parts of n-butyl acrylate, 5 parts of a yellow pigment ("Toner Yellow HG VP2155", trade name; product of Clariant Co.) and 3 parts of Charge Control Resin A were stirred and mixed by an ordinary stirring device and then uniformly dispersed by a media type dispersing machine. Ten parts of dipentaerythritol hexamyristate were added to and mixed with the resultant mixture into a solution, thereby obtaining a polymerizable monomer composition.

On the other hand, an aqueous solution with 5.8 parts of sodium hydroxide (alkali metal hydroxide) dissolved in 50 parts of ion-exchanged water was gradually added to an aqueous solution with 9.5 parts of magnesium chloride (water-soluble polyvalent metal salt) dissolved in 250 parts of ion-exchanged water under stirring to prepare a dispersion of magnesium hydroxide colloid (colloid of hardly water-soluble metal hydroxide).

The polymerizable monomer composition was poured into the colloidal dispersion of magnesium hydroxide obtained above, the mixture was stirred until droplets became stable, and 6 parts of t-butyl peroxy-2-ethylhexanoate was then added as a polymerization initiator to the mixture. The resultant mixture was stirred 30 minutes at 15,000 rpm under high shearing force by means of an Ebara Milder ("MDN303 V Model", manufactured by Ebara Corporation) to form fine droplets of the monomer mixture. The thus-prepared aqueous dispersion containing droplets of the monomer mixture was charged into a reactor equipped with an agitating blade to initiate a polymerization reaction at 90° C. After the polymerization was continuously conducted for 8 hours, the reaction was stopped to obtain an aqueous dispersion of polymer particles having a pH of 9.5.

While stirring the above-obtained aqueous dispersion of the polymer particles, the pH of the system was adjusted to about 5.5 with sulfuric acid to conduct acid washing (25° C., 10 minutes). Filtration and hydration were then conducted, and washing water was sprayed on the residue after the dehydration to conduct water washing. Thereafter, the thus-treated residue was dried for 2 days by a dryer (at 45° C.) to obtain positively charged toner particles having a volume average particle diameter (dv) of 6.7 μm.

(3) Addition of External Additive:

To 100 parts of the toner particles obtained above were added 1.2 parts of silica ("HVK H2150", trade name; product of WACKER CHEMIE Co.) having an average particle diameter of 8 nm subjected to a hydrophobicity-imparting treatment, and they were mixed by means of a Henschel mixer to prepare a non-magnetic one-component toner (yellow toner) positively charged.

The positively charged toner thus obtained was evaluated. The evaluation revealed that the toner was excellent in fixing ability, shelf stability and flowability, and provided extremely good images good in color tone, high in image density and free of fog at both high temperature and high humidity, and low temperature and low humidity. The evaluation results are shown in Table 1.

Example 2

Charge Control Resin B having Mw of 16,000 and Tg of 68° C. was prepared in the same manner as in Example 1 except that the amount of styrene was changed to 78 parts, and butyl acrylate was changed to 19 parts of 2-ethylhexyl acrylate. A positively charged toner was obtained in the same manner as in Example 1 except that Charge Control Resin B was used as a charge control resin. The positively charged toner thus obtained was evaluated. The evaluation revealed that the toner was excellent in fixing ability, shelf stability and flowability, and provided extremely good images good in color tone, high in image density and free of fog at both high temperature and high humidity, and low temperature and low humidity. The evaluation results are shown in Table 1.

Example 3

(1) Preparation of Core Particles:

A monomer component (calculated Tg of the resulting copolymer=50° C.) for core composed of 78 parts of styrene and 22 parts of n-butyl acrylate, 5 parts of a magenta pigment ("Toner Magenta E-02", trade name; product of Clariant Co), 3 parts of Charge Control Resin A, 0.8 parts of a polymethacrylic ester macromonomer ("AA6", trade name; Tg=94° C.; product of Toagosei Chemical Industry Co., Ltd.), and 10 parts of pentaerythritol tetramyristate were stirred in an ordinary stirring device until the resulting mixture became uniform, in which 6 parts of t-butyl peroxy-2-ethylhexanoate were dissolved to obtain a polymerizable monomer composition for core.

On the other hand, an aqueous solution with 6.9 parts of sodium hydroxide (alkali metal hydroxide) dissolved in 50 parts of ion-exchanged water was gradually added to an aqueous solution with 9.8 parts of magnesium chloride (water-soluble polyvalent metallic salt) dissolved in 250 parts of ion-exchanged water under stirring to prepare a dispersion of magnesium hydroxide colloid (colloid of hardly water-soluble metal hydroxide).

The monomer composition for core was poured into the colloidal dispersion of magnesium hydroxide obtained above, and the mixture was stirred and mixed for 30 minutes at 15,000 rpm under high shearing force by means of an Ebara Milder ("MDN303 V Model", manufactured by Ebara Corporation), thereby uniformly dispersing the monomer composition to form fine droplets of the monomer composition for core.

The thus-prepared aqueous dispersion containing droplets of the monomer composition for core was charged into a reactor equipped with an agitating blade to initiate a polymerization reaction at 90° C. At the time the conversion of the monomer into a polymer reached 95%, sampling was conducted to measure the volume average particle diameter (dv) and particle diameter distribution (dv/dp) of core particles formed. As a result, the volume average particle diameter was 5.7 $\mu$m, and the particle diameter distribution was 1.32.

(2) Formation of Shell:

Two parts of methyl methacrylate (calculated Tg of the resulting polymer=105° C.) and 100 parts of water were subjected to a finely dispersing treatment by an ultrasonic emulsifier to obtain an aqueous dispersion of a monomer for shell.

This aqueous dispersion of the monomer for shell and 25 parts of a 10% aqueous solution of ammonium persulfate were added to the reactor after the sampling to continue the reaction for 5 hours. The reaction was then stopped to obtain an aqueous dispersion of core-shell type polymer particles.

The thickness of the shell as calculated out from the particle diameter of the core particles right before the addition of the monomer for shell and the amount of the monomer for shell was 0.02 $\mu$m, and the spheroidicity (rl/rs) of the resultant core-shell type polymer particles was 1.1.

While stirring the aqueous dispersion of core-shell type polymer particles obtained above, the pH of the system was adjusted to 6.0 or lower with sulfuric acid to conduct acid washing (at 25° C. for 10 minutes). After the thus-treated dispersion was filtered to separate water, 500 parts of ion-exchanged water was newly added to form a slurry again to conduct water washing. Thereafter, the dehydration and water washing were conducted repeatedly several times, and solids were then collected by filtration and dried at 45° C. for 2 days by a dryer to obtain polymer particles.

(3) Addition of External Additive:

To 100 parts of the core-shell type polymer particles obtained above were added 0.8 parts of colloidal silica ("RX200", trade name; product of Nippon Aerosil Co., Ltd.) subjected to a hydrophobicity-imparting treatment, and they were mixed by means of a Henschel mixer to prepare a capsule toner positively charged.

The fixing temperature of the positively charged toner obtained above was measured and found to be 120° C. The shelf stability of this toner was 3% and hence very good. The results are shown in Table 1. Besides, the evaluation of image revealed that images high in image density, free of fog and unevenness and extremely good in resolution were obtained.

Example 4

A positively charged toner was obtained in the same manner as in Example 3 except that the charge control resin was changed to 3 parts of Charge Control Resin B, and the colorant was changed to a cyan pigment ("GN-X", product of Sumika Color Co., Ltd.). This toner was evaluated. The evaluation revealed that the toner was excellent in fixing ability and shelf stability, and provided extremely good images good in color tone, high in image density and free of fog at both high temperature and high humidity, and low temperature and low humidity. The evaluation results are shown in Table 1.

Comparative Example 1

Charge Control Resin C having Tg of 37° C. and Mw of 20,000 was obtained in the same manner as in Example 1 except that the amount of styrene was changed to 67 parts, and 22 parts of butyl acrylate was changed to 30 parts of 2-ethylhexyl acrylate. A positively harged toner was prepared in the same manner as in Example 3 except that Charge Control Resin C was used as a charge control resin, and evaluated. The evaluation revealed that the toner was poor in shelf stability and flowability, images formed from the toner had fog to a great extent, and an unsatisfactory image was obtained in the evaluation of durability. The evaluation results are shown in Table 1.

Comparative Example 2

Charge Control Resin D having Tg of 76° C. and Mw of 21,000 was obtained in the same manner as in Example 2 except that the amounts of styrene and 2-ethylhexyl acrylate were changed to 87 parts and 10 parts, respectively. A positively charged toner was prepared in the same manner as in Example 4 except that Charge Control Resin D was used as a charge control resin, and evaluated. As a result, the toner was insufficient in fixing ability. The evaluation results are shown in Table 1.

Comparative Example 3

Charge Control Resin E having Tg of 92° C. and Mw of 18,000 was obtained in the same manner as in Example 1 except that the amounts of styrene and butyl acrylate were changed to 75 parts and 0 part, respectively, and 25 parts of 2-acrylamido-2-methylpropanesulfonic acid were used.

A positively charged toner was prepared in the same manner as in Example 3 except that Charge Control Resin E was used as a charge control resin, and the colorant was changed to 5 parts of a yellow pigment ("Toner Yellow HG VP2155", trade name; product of Clariant Co.), and evaluated. As a result, the toner was insufficient in fixing ability and environmental dependence under high temperature and high humidity. The evaluation results are shown in Table 1.

TABLE 1

| | Example | | | | Comparative Example | | |
|---|---|---|---|---|---|---|---|
| | 1 | 2 | 3 | 4 | 1 | 2 | 3 |
| Charge control resin | A | B | A | B | C | D | E |
| Weight average molecular weight ($\times 10^4$) | 3.0 | 1.6 | 3.0 | 1.6 | 2.0 | 2.1 | 1.8 |
| Tg (° C.) | 42 | 68 | 42 | 68 | 37 | 76 | 92 |
| Amount added (parts) | 3 | 3 | 3 | 3 | 3 | 3 | 3 |
| Pigment | Yellow | Yellow | Magenta | Cyan | Magenta | Cyan | Yellow |
| Amount added (parts) | 5 | 5 | 5 | 5 | 5 | 5 | 5 |
| Particle diameter (Dv) of toner (μm) | 6.7 | 6.5 | 6.9 | 7.2 | 7.1 | 7.3 | 6.8 |
| Particle diameter distribution Dv/Dp | 1.3 | 1.2 | 1.3 | 1.3 | 1.3 | 1.3 | 1.3 |
| Spheroidicity | 1.1 | 1.1 | 1.2 | 1.1 | 1.2 | 1.1 | 1.1 |
| Diameter of core (μm) | — | — | 6.8 | 7.1 | 7.0 | 7.2 | 6.9 |
| Thickness of shell (μm) | — | — | 0.02 | 0.02 | 0.02 | 0.02 | 0.02 |
| Environmental dependence: | | | | | | | |
| (H/H) | ○ | ○ | ○ | ○ | ○ | Δ | Δ |
| (L/L) | ○ | ○ | ○ | ○ | Δ | ○ | ○ |
| Durability | ○ | ○ | ○ | ○ | X | X | X |
| Shelf stability (%) | 4 | 2 | 3 | 2 | 32 | 2 | 2 |
| Flowability | 65 | 66 | 68 | 64 | 42 | 68 | 70 |
| Fixing temperature (° C.) | 145 | 150 | 130 | 135 | 135 | 160 | 170 |

INDUSTRIAL APPLICABILITY

According to the present invention, there are provided toners for electrostatic image development, which are excellent in charge stability, good in durability and low in environmental dependence, and a production process thereof.

According to the present invention, there are also provided toners for electrostatic image development, which have a low fixing temperature, are well balanced between shelf stability and fixing ability, can meet the speeding-up of printing, and are suitable for use as color toners, and a production process thereof.

The core-shell type toners according to the present invention have excellent printing properties, can be fixed at a temperature lower than the conventional fixing temperature, have excellent fixing ability even in high-speed printing or copying, cause no color irregularity even in color printing or copying and can hence be suitably used in general printers and copying machines.

The polymerized color toners according to the present invention have excellent charge stability, can provide images good in durability and low in environmental dependence, and cause no color irregularity even in color printing or copying.

What is claimed is:

1. A toner for electrostatic image development, comprising at least a binder resin, a colorant and a charge control resin, wherein the charge control resin is a copolymer composed a vinyl monomer unit and a quaternary ammonium salt group-containing (meth)acrylate monomer unit and has a glass transition temperature of 40 to 75° C.

2. The toner for electrostatic image development according to claim 1, wherein the content of the quaternary ammonium salt group-containing (meth)acrylate monomer unit in the charge control resin is 0.05 to 12% by weight.

3. The toner for electrostatic image development according to claim 1, wherein the vinyl monomer in the charge control resin comprises a vinyl aromatic hydrocarbon monomer unit and a (meth)acrylate monomer unit.

4. The toner for electrostatic image development according to claim 1, wherein the vinyl monomer in the charge control resin comprises a vinyl aromatic hydrocarbon monomer unit and a (meth)acrylate monomer unit, and a weight ratio between them is 70:30 to 90:10.

5. The toner for electrostatic image development according to claim 1, wherein a difference in glass transition temperature between the binder resin and the charge control resin is 0 to 20° C.

6. The toner for electrostatic image development according to claim 1, wherein the weight average molecular weight of the charge control resin is 2,000 to 40,000.

7. The toner for electrostatic image development according to claim 1, wherein the colorant is a yellow, magenta or cyan colorant.

8. A toner for electrostatic image development, which is a core-shell type toner that a shell layer of a polymer having a glass transition temperature higher than the glass transition temperature of a binder resin in core particles containing at least the binder resin, a colorant and a charge control resin is formed on the core particles, wherein the charge control resin is a copolymer composed a vinyl monomer unit and a quaternary ammonium salt group-containing (meth)acrylate monomer unit and has a glass transition temperature of 40 to 75° C.

9. A toner for electrostatic image development, comprising at least a binder resin, a colorant and a charge control resin, wherein the charge control resin is a copolymer composed a vinyl monomer and a quaternary ammonium salt group-containing (meth)acrylate monomer and has a glass transition temperature of 40 to 75° C.

10. A process for producing a toner for electrostatic image development, comprising suspending a monomer composition containing at least a polymerizable monomer, a colorant and a charge control resin in an aqueous dispersion medium containing a dispersion stabilizer and polymerizing the monomer using a polymerization initiator, wherein the charge control resin is a copolymer composed a vinyl monomer unit and a quaternary ammonium salt group-containing (meth)acrylate monomer unit and has a glass transition temperature of 40 to 75° C.

11. A process for producing a core-shell type toner for electrostatic image development, comprising suspending a monomer composition containing at least a polymerizable monomer, a colorant and a charge control resin in an aqueous dispersion medium containing a dispersion stabilizer, polymerizing the monomer using a polymerization initiator, thereby forming core particles, and then adding and polymerizing a polymerizable monomer for shell, which is capable of forming a polymer having a glass transition temperature higher than that of a polymer formed from the first mentioned polymerizable monomer, in the presence of the core particles, wherein the charge control resin is a copolymer composed a vinyl monomer unit and a quaternary ammonium salt group-containing (meth)acrylate monomer unit and has a glass transition temperature of 40 to 75° C.

* * * * *